US006581239B1

(12) United States Patent
Dyson et al.

(10) Patent No.: US 6,581,239 B1
(45) Date of Patent: Jun. 24, 2003

(54) CLEANER HEAD FOR A VACUUM CLEANER

(75) Inventors: James Dyson, Wiltshire (GB); Michael David Ganderton, Wiltshire (GB)

(73) Assignee: Dyson Limited, Malmesbury (GB)

( * ) Notice: Subject to any disclaimer, the term of this patent is extended or adjusted under 35 U.S.C. 154(b) by 0 days.

(21) Appl. No.: 09/868,483

(22) PCT Filed: Dec. 6, 1999

(86) PCT No.: PCT/GB99/04107

§ 371 (c)(1),
(2), (4) Date: Jun. 18, 2001

(87) PCT Pub. No.: WO00/36965

PCT Pub. Date: Jun. 29, 2000

(30) Foreign Application Priority Data

Dec. 18, 1998 (GB) ..... 9827782

(51) Int. Cl.[7] ..... A47L 9/04
(52) U.S. Cl. ..... 15/340.3; 15/353; 15/359
(58) Field of Search ..... 15/340.3, 353, 15/359

(56) References Cited

U.S. PATENT DOCUMENTS

| | | | | | |
|---|---|---|---|---|---|
| 2,103,054 | A | * | 12/1937 | Becker | 15/354 |
| 3,540,073 | A | * | 11/1970 | Issenmann et al. | 15/340.3 |
| 3,879,789 | A | * | 4/1975 | Kasper | 15/340.3 |
| 3,942,218 | A | * | 3/1976 | Krier et al. | 15/340.3 |
| 4,741,072 | A | * | 5/1988 | Wilkerson | 15/340.3 |
| 5,109,566 | A | | 5/1992 | Kobayashi et al. | 15/340.1 |
| 5,147,002 | A | * | 9/1992 | Hughes | 15/359 |
| 5,483,718 | A | | 1/1996 | Blehert et al. | 15/340.2 |
| 5,534,762 | A | | 7/1996 | Kim | 15/340.1 |
| 5,542,148 | A | * | 8/1996 | Young | 15/340.3 |
| 5,682,640 | A | | 11/1997 | Han | 15/319 |
| 5,781,960 | A | | 7/1998 | Kilstrom et al. | 15/319 |
| 6,088,873 | A | * | 7/2000 | Pacchini et al. | 15/340.3 |

FOREIGN PATENT DOCUMENTS

| | | |
|---|---|---|
| EP | 0 037 674 A | 10/1981 |
| EP | 0 134 654 A | 3/1985 |
| EP | 0 415 563 A | 3/1991 |
| GB | 2 072 495 A | 10/1981 |

* cited by examiner

*Primary Examiner*—Theresa T. Snider
(74) *Attorney, Agent, or Firm*—Morrison & Foerster LLP

(57) ABSTRACT

The invention provides a vacuum cleaner (10) comprising a main body (12) and a cleaner head (22) movably mounted theon, the cleaner head (22) having a downwardly directed suction opening (24), characterised in that the cleaner head (22) is mounted on the main body (12) by means of at least one articulating member (120), the or each articulating member (120) having a first end which is pivotably connected to the cleaner head (22) and a second end which is pivotably connected to the main body (12). The arrangement provides a cleaner head (22) which is doubly articulated with respect to the main body (12) which allows the cleaner head (22) greater flexibility of movement than known cleaner heads

17 Claims, 6 Drawing Sheets

CLEANER HEAD FOR A VACUUM CLEANER

This application claims priority to International Application No. PCT/GB99/04107 which was published on Dec. 6, 1999.

The invention relates to a vacuum cleaner, particularly to a vacuum cleaner having a cleaner head.

FIELD OF THE INVENTION

Upright vacuum cleaners commonly include cleaner heads which are pivotably attached to the main body or casing of the vacuum cleaner to allow the main casing (which includes a handle) to be tilted away from to the vertical for conventional upright use. Examples of upright cleaners having pivotable cleaner heads are shown in EP 0 037 674 and EP 0 134 654. Many vacuum cleaners having similarly mounted cleaner heads are available on the open market. The pivotable connection between the cleaner head and the main casing also allows the cleaner head to lift away from the surface when small obstacles or irregularities in the floor surface are encountered by the cleaner head during the cleaning operation. However, the arrangement of known upright cleaners allows the respective cleaner head to move only in an arcuate manner with respect to the main body of the cleaner. When this type of lifting occurs, the cleaner head can become separated from the surface for longer than is necessary or desirable and cleaning can be unsatisfactory over some parts of the surface being cleaned.

BACKGROUND OF THE INVENTION

Proposals have been made in respect of robotic vacuum cleaners. These are cleaners which are capable of operating independently of a user by making use of on-board navigation and control apparatus so as to be able to navigate around a closed environment, ie a room which is required to be cleaner, without becoming lodged against furniture in the room. In many of the prior art proposals, the cleaner head is located underneath the main body of the cleaner without being movable with respect thereto (see, for example, U.S. 5,109,566 and U.S. 5,682,640). These machines are designed to clean only smooth, regular surfaces and are therefore unsuitable for domestic use or use in any other environment where cleaning of a variety of different surfaces is required. In other proposals, for example, U.S. 5,781,960 and U.S. 5,534,762, the cleaner head is pivotably mounted on the underside of the main body or chassis so that it can float on the surface to be cleaned and this arrangement will allow the cleaner head to lift in a similar manner to that of the arrangement commonly found on upright cleaners. However, the cleaner head of each of these latter proposals still has the disadvantage that parts of the floor will not be cleaned adequately if obstacles or uneven surfaces are encountered.

SUMMARY OF THE INVENTION

It is an object of the present invention to provide a vacuum cleaner having a cleaner head which is capable of maintaining close contact with the surface to be cleaned even when small obstacles and/or uneven surfaces are encountered. It is a further object of the present invention to provide a vacuum cleaner which performs better than known vacuum cleaners when small obstacles and/or uneven surfaces are encountered. It is a still further object of the present invention to provide a vacuum cleaner having a cleaner head which is capable of remaining in a position which is substantially parallel to the surface to be cleaned, irrespective of the inclination thereof.

The invention provides a vacuum cleaner comprising a main body and a cleaner head movably mounted thereon, the cleaner head having a downwardly directed suction opening, characterised in that the cleaner head is mounted on the main body by means of at least one articulating member having a first end which is pivotably connected to the cleaner head and a second end which is pivotably connected to the main body.

The provision of at least one articulating member pivotably connected at one end to the cleaner head and at the other end to the main body allows the cleaner head freedom of movement to follow the contours of the surface to be cleaned if they are uneven. It also allows the cleaner head to climb over small obstacles without coming out of contact with the surface for longer than is absolutely necessary. If two such articulating members are provided parallel to one another and spaced along the cleaner head, the arrangement is particularly effective in allowing freedom of movement whilst still maintaining the correct alignment of the cleaner head with respect to the main body of the vacuum cleaner.

BRIEF DESCRIPTION OF THE DRAWINGS

An embodiment of the invention will now be described, by way of example only, with reference to the accompanying drawings, wherein.

DETAILED DESCRIPTION OF THE INVENTION

Figure 1:
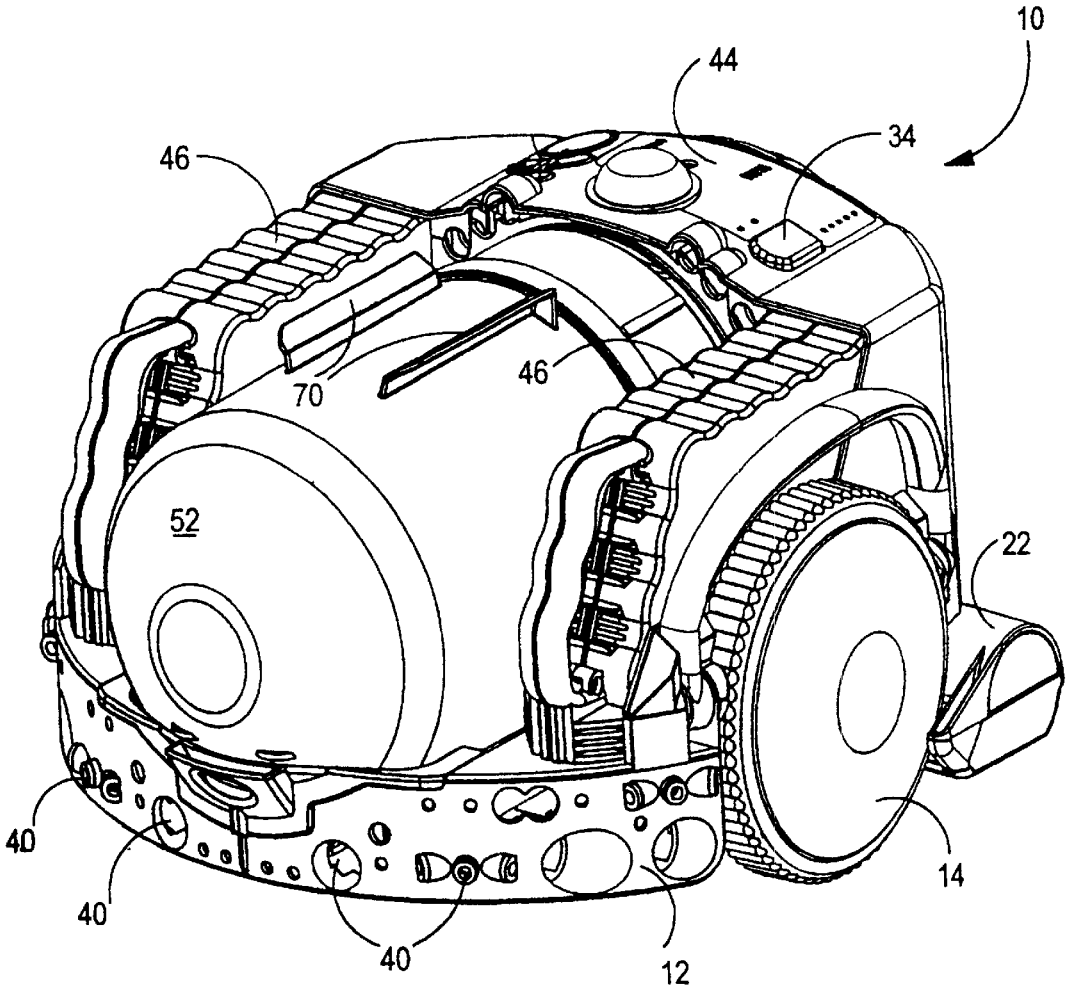
FIG. 1 is a perspective view of a vacuum cleaner according to the invention.

The vacuum cleaner 10 shown in the drawings has a supporting chassis 12 which is generally circular in shape and is supported on two driven wheels 14 and a castor wheel 16. The chassis 12 is preferably manufactured from high-strength moulded plastics material, such as ABS, but can equally be made from metal such as aluminium or steel. The chassis 12 provides support for the components of the cleaner 10 which will be described below. The driven wheels 14 are arranged at either end of a diameter of the chassis 12, the diameter lying perpendicular to the longitudinal axis 18 of the cleaner 10. Each driven wheel 14 is moulded from a high-strength plastics material and carries a comparatively soft, ridged band around its circumference to enhance the grip of the wheel 14 when the cleaner 10 is traversing a smooth floor. The driven wheels 14 are mounted independently of one another via support bearings (not shown) and each driven wheel 14 is connected directly to a motor 15 which is capable of driving the respective wheel 14 in either a forward direction or a reverse direction. By driving both wheels 14 forward at the same speed, the cleaner 10 can be driven in a forward direction. By driving both wheels 14 in a reverse direction at the same speed, the cleaner 10 can be driven in a backward direction. By driving the wheels 14 in opposite directions, the cleaner 10 can be made to rotate about its own central axis so as to effect a turning manoeuvre. The aforementioned method of driving a vehicle is well known and will not therefore be described any further here.

Figure 3:
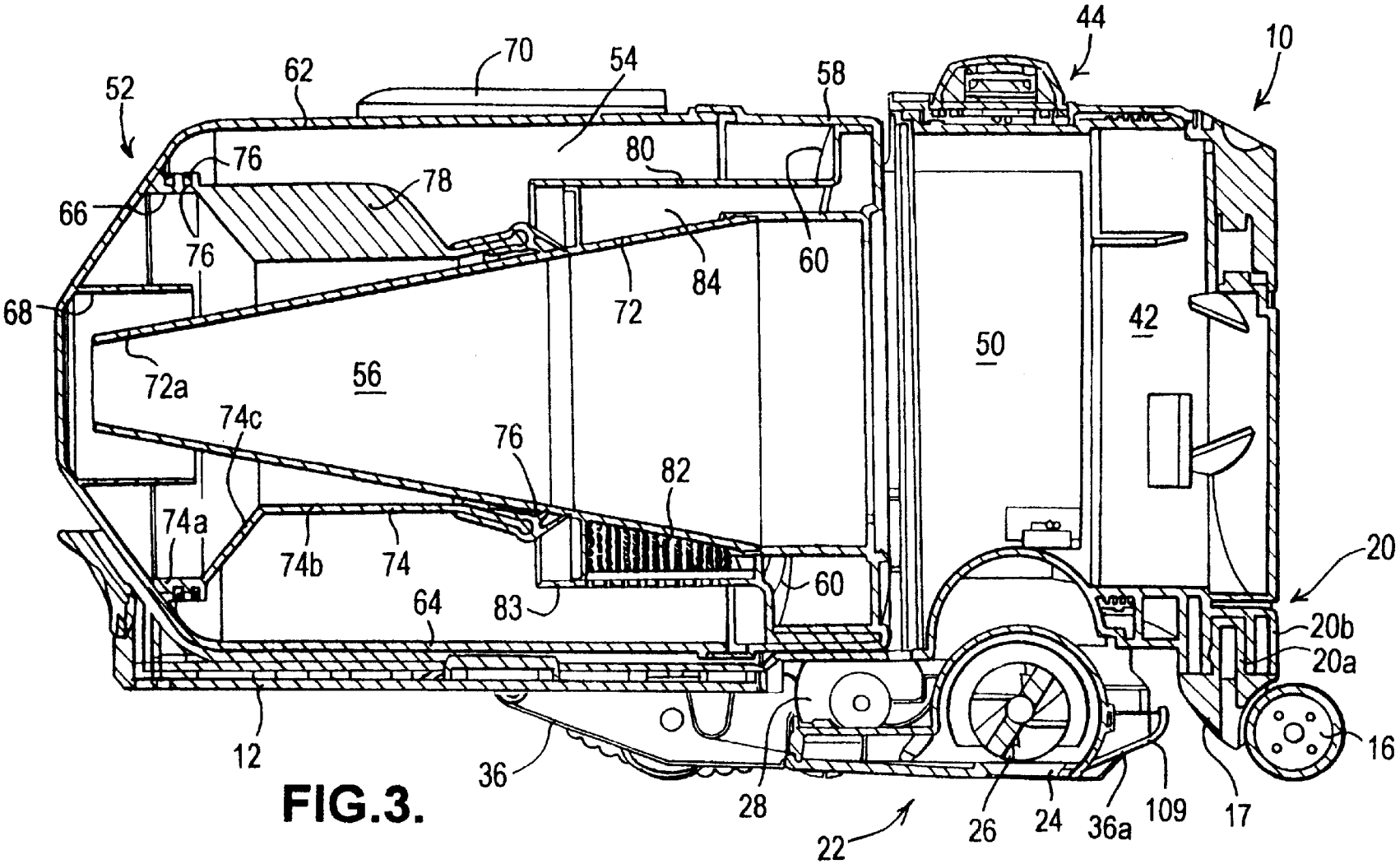
FIG. 3 is a sectional view through the vacuum cleaner of FIG. 1 taken along the line III—III of FIG. 2.

The castor wheel 16 is significantly smaller in diameter than the driven wheels 14 as can be seen from, for example, FIG. 3. The castor wheel 16 is not driven and merely serves to support the chassis 12 at the rear of the cleaner 10. The location of the castor wheel 16 at the trailing edge of the chassis 12, and the fact that the castor wheel 16 is swivellingly mounted on the chassis by means of a swivel joint 20, allows the castor wheel 16 to trail behind the cleaner 10 in a manner which does not hinder the maneuverability of the cleaner 10 whilst it is being driven by way of the driven wheels 14. The swivel joint 20 is most clearly shown in FIG. 3. The castor wheel 16 is fixedly attached to an upwardly extending cylindrical member 20*a* which is received by an annular housing 20*b* to allow free rotational movement of the cylindrical member 20*a* therewithin. This type of arrangement is well known. The castor wheel 16 can be made from a moulded plastics material or can be formed from another synthetic material such as Nylon.

Mounted on the underside of the chassis 12 is a cleaner head 22 which includes a suction opening 24 facing the surface on which the cleaner 10 is supported. The suction opening 24 is essentially rectangular and extends across the majority of the width of the cleaner head 22. A brush bar 26 is rotatably mounted in the suction opening 24 and a motor 28 is mounted on the cleaner head 22 for driving the brush bar 26 by way of a drive belt (not shown) extending between a shaft of the motor 28 and the brush bar 26. The cleaner head 22 is mounted on the chassis 12 in such a way that the cleaner head 22 is able to float on the surface to be cleaned. This is achieved by a mounting which includes double articulation between the cleaner head 22 and the chassis 12 and will be described in greater detail below. The double articulation of the connection between the cleaner head 22 and the chassis 12 allows the cleaner head 22 to move freely in a vertical direction with respect to the chassis 12. This enables the cleaner head 22 to climb over small obstacles such as books, magazines, rug edges, etc. Obstacles of up to approximately 25 mm in height can be traversed in this way. The castor wheel 16 also includes a ramped portion 17 which provides additional assistance when the cleaner 10 encounters an obstacle and is required to climb over it. In this way, the castor wheel 16 will not become lodged against the obstacle after the cleaner head 22 has climbed over it.

Figure 2:
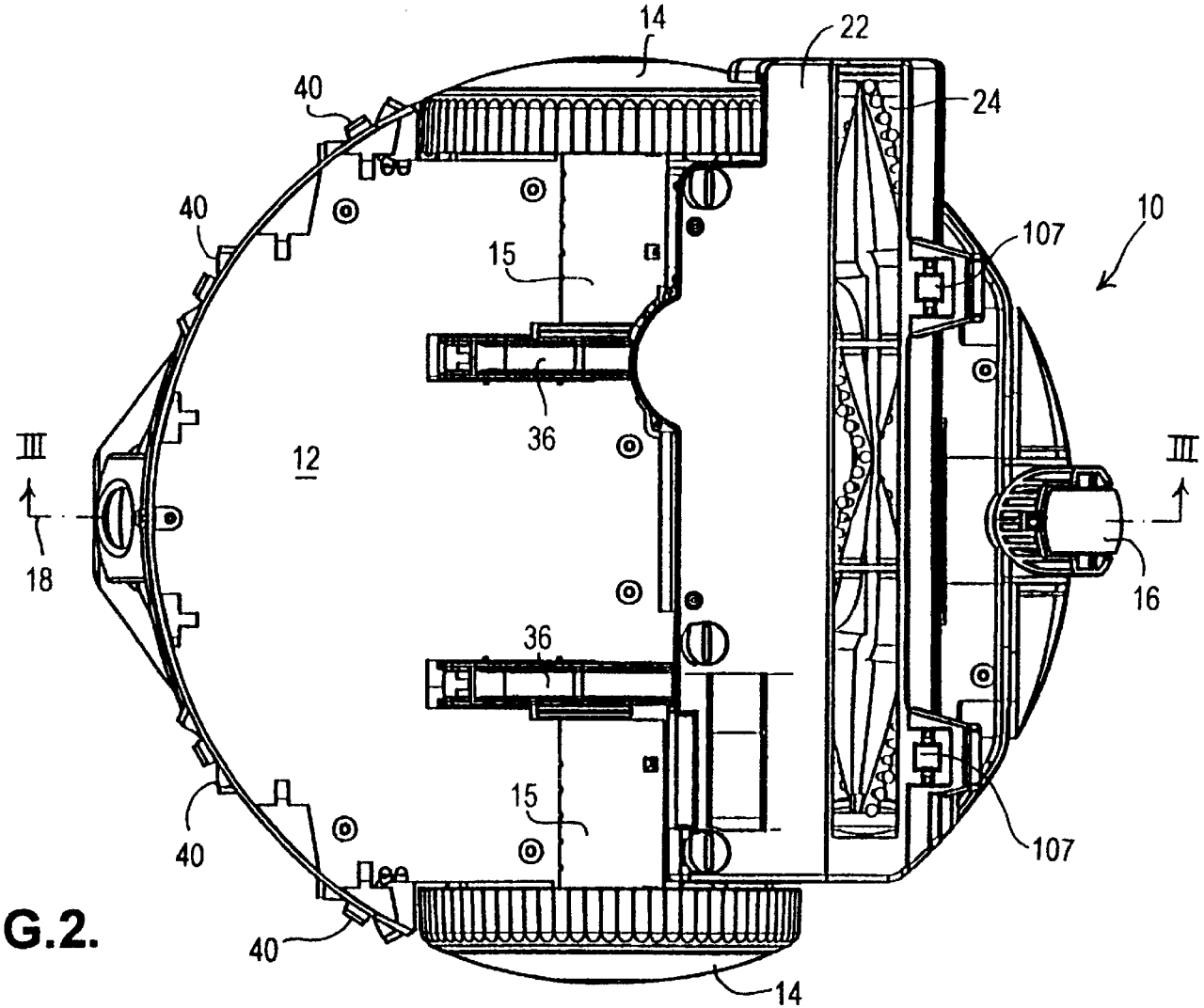
FIG. 2 is an underneath view of the vacuum cleaner of FIG. 1.

As can be seen from FIG. 2, the cleaner head 22 is asymmetrically mounted on the chassis 12 so that one side of the cleaner head 22 protrudes beyond the general circumference of the chassis 12. This allows the cleaner 10 to clean up to the edge of a room on the side of the cleaner 10 on which the cleaner head 22 protrudes.

The chassis 12 carries a plurality of sensors 40 which are designed and arranged to detect obstacles in the path of the cleaner 10 and its proximity to, for example, a wall or other boundary such as a piece of furniture. The sensors 40 comprise several ultra-sonic sensors and several infra-red sensors. The array illustrated in FIG. 1 is not intended to be limitative and the arrangement of the sensors does not form part of the present invention. Suffice it to say that the vacuum cleaner 10 carries sufficient sensors and detectors 40 to enable the cleaner 10 to guide itself or to be guided around a predefined area so that the said area can be cleaned. Control software, comprising navigation controls and steering devices, is housed within a housing 42 located beneath a control panel 44 or elsewhere within the cleaner 10. Battery packs 46 are mounted on the chassis 12 inwardly of the driven wheels 14 to provide power to the motors 15 for driving the wheels 14 and to the control software. The battery packs 46 are removable to allow them to be transferred to a battery charger (not shown). The vacuum cleaner 10 also includes a motor and fan unit 50 supported on the chassis 12 for drawing dirty air into the vacuum cleaner 10 via the suction opening 24 in the cleaner head 22.

Figure 4A:
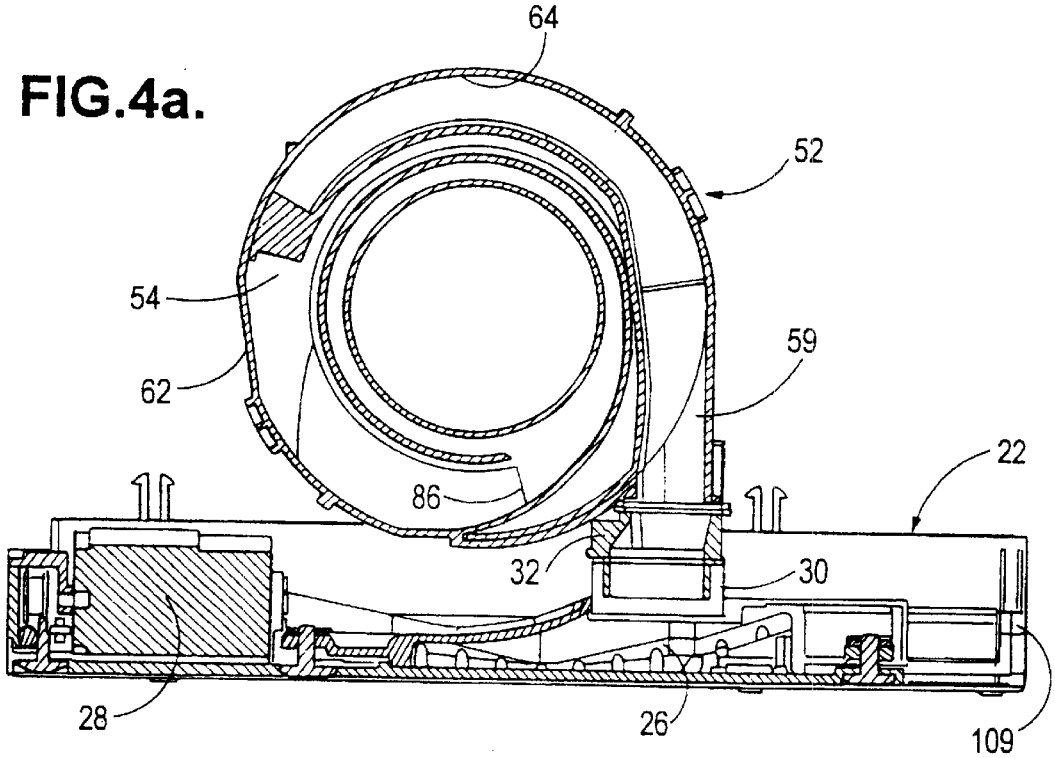
FIG. 4*a* is a transverse sectional view through part of the cleaner of FIG. 1 showing the cleaner head in a first position.
Figure 4B:
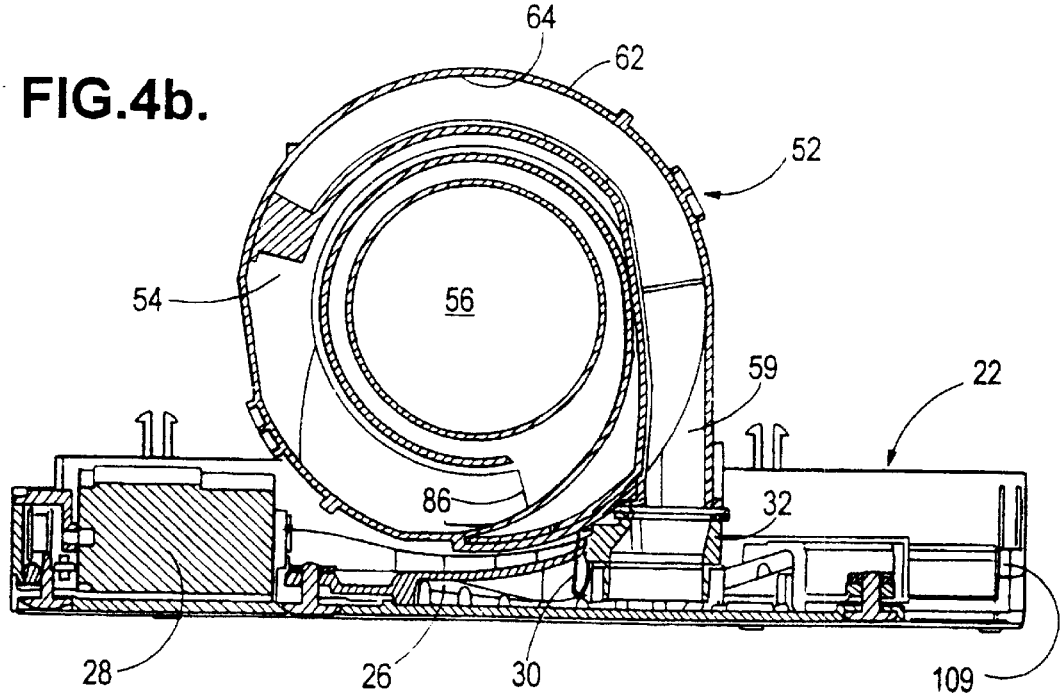
FIG. 4*b* is a transverse sectional view through part of the cleaner of FIG. 1 showing the cleaner head in a second position.

The chassis 12 also carries a cyclonic separator 52 for separating dirt and dust from the air drawn into the cleaner 10. The features of the cyclonic separator 52 are best seen from FIGS. 3 and 4. The cyclonic separator 52 comprises an outer cyclone 54 and an inner cyclone 56 arranged concentrically therewith, both cyclones 54, 56 having their coaxial axes lying horizontally. The cyclonic separator 52 comprises an end portion 58 which has a tangential inlet 59. The tangential inlet 59 has a mouth at the distal end thereof. The mouth is generally circular in shape, but is somewhat flattened along one edge to give the mouth a vaguely D-shaped section. The end portion 58 is otherwise generally cylindrical and has an end wall 60 which is generally helical. The end portion 58 opens directly into a cylindrical bin 62 having an outer wall 64 whose diameter is the same as that of the end portion 58. The end portion 58 and the cylindrical bin 62 are held together by way of a releasable clip which can be of any known design. No specific clip is shown in the drawings. A lip seal is provided between the cylindrical bin 62 and the end portion 52 in order to maintain a good seal between the respective parts. The cylindrical bin 62 is made from a transparent plastics material to allow a user to view the interior of the outer cyclone 54. The end of the bin 62 remote from the end portion 58 is frusto-conical in shape and closed. A locating ring 66 is formed integrally with the end of the bin at a distance from the outer wall 64 thereof and a dust ring 68 is also formed integrally with the end of the bin 62 inwardly of the locating ring 66. Located on the outer surface of the bin 62 are two opposed gripper portions 70 which are adapted to assist a user to remove the separator 52 from the chassis 12 for emptying purposes. Specifically, the gripper portions 70 are molded integrally with the transparent bin 62 and extend upwardly and outwardly from the outer wall 64 so as to form an undercut profile as shown in FIG. 1.

The inner cyclone 56 is formed by a partially-cylindrical, partially-frusto-conical cyclone body 72 which is rigidly attached to the end face of the end portion 58. The cyclone body 72 lies along the longitudinal axis of the transparent bin 62 and extends almost to the end face thereof so that the distal end 72*a* of the cyclone body 72 is surrounded by the dust ring 68. The gap between the cone opening at the distal end 72*a* of the cyclone body 72 and the end face of the bin 62 is preferably less than 8 mm.

A fine dust collector 74 is located in the bin 62 and is supported by the locating ring 66 at one end thereof. The fine dust collector 74 is supported at the other end thereof by the cyclone body 72. Seals 76 are provided between the fine dust collector 74 and the respective support at either end. The fine dust collector 74 has a first cylindrical portion 74*a* adapted to be received within the locating ring 66, and a second cylindrical portion 74*b* having a smaller diameter than the first cylindrical portion 74*a*. The cylindrical portions 74*a*, 74*b* are joined by a frusto-conical portion 74*c* which is integrally moulded therewith. A single fin or baffle 78 is also moulded integrally with the fine dust collector 74 and extends radially outwardly from the second cylindrical portion 74*b* and from the frusto-conical portion 74*c*. The outer edge of the fin 78 is aligned with the first cylindrical portion 74*a* and the edge of the fin 78 remote from the first cylindrical portion 74*a* is essentially parallel to the frusto-conical portion 74*c*. The fin 78 extends vertically upwardly from the fine dust collector 74.

A shroud 80 is located between the first and second cyclones 54, 56. The shroud 80 is cylindrical in shape and is supported at one end by the end portion 58 and by the cyclone body 72 of the inner cyclone 56 at the other end. As is known, the shroud 80 has perforations 82 extending therethrough and a lip 83 projecting from the end of the shroud 80 remote from the end portion 58. A channel 84 is formed between the shroud 80 and the outer surface of the cyclone body 72, which channel 84 communicates with an entry port 86 leading to the interior of the inner cyclone 56 in a manner which encourages the incoming airflow to adopt a swirling, helical path. This is achieved by means of a tangential or scroll entry into the inner cyclone 56 as can be seen from FIG. 4. A vortex finder (not shown) is mounted on the housing of the motor and fan unit 50 and extends into the second cyclone 56 through an aperture in the end wall 60 of the end portion 58. The vortex finder is located centrally of the larger end of the inner cyclone 56 to conduct air out of the cyclonic separator 52 after separation has taken place. It also helps to secure the cyclonic separator 52 in position on the chassis 12. The exiting air is conducted past the motor and fan unit 50 so that the motor can be cooled before the air is expelled to atmosphere. Additionally, a post-motor filter (not shown) can be provided downstream of the motor and fan unit 50 in order to further minimise the risk of emissions into the atmosphere from the vacuum cleaner 10.

Figure 6A:
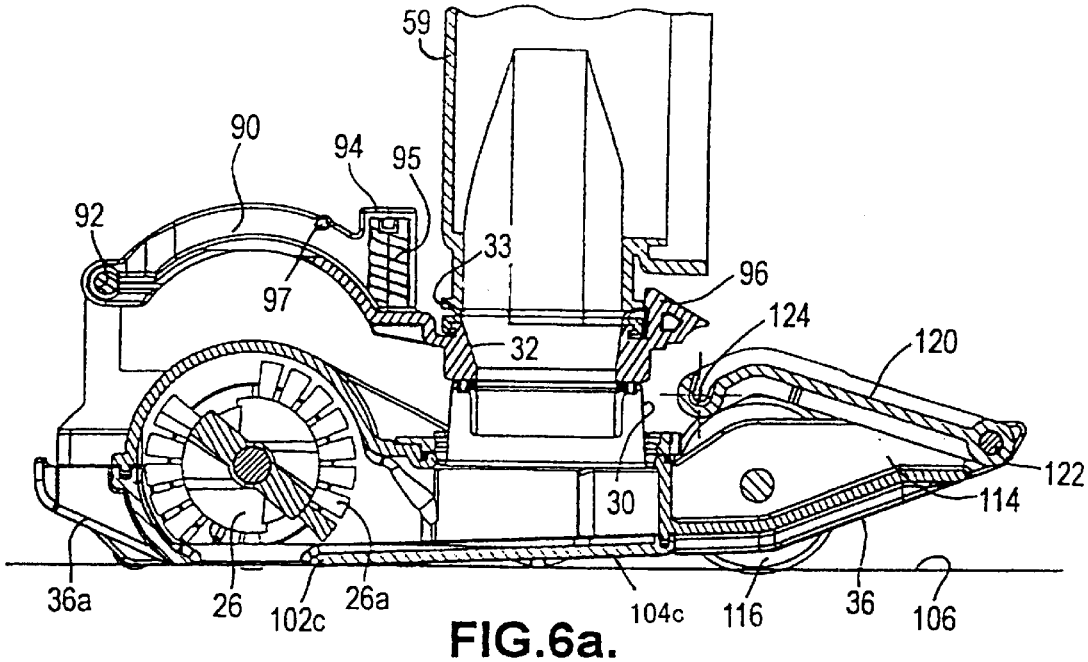
FIG. 6*a* is a sectional view through the cleaner head of FIG. 5 showing the cleaner head in the first position as shown in FIG. 4*a*.
Figure 6B:
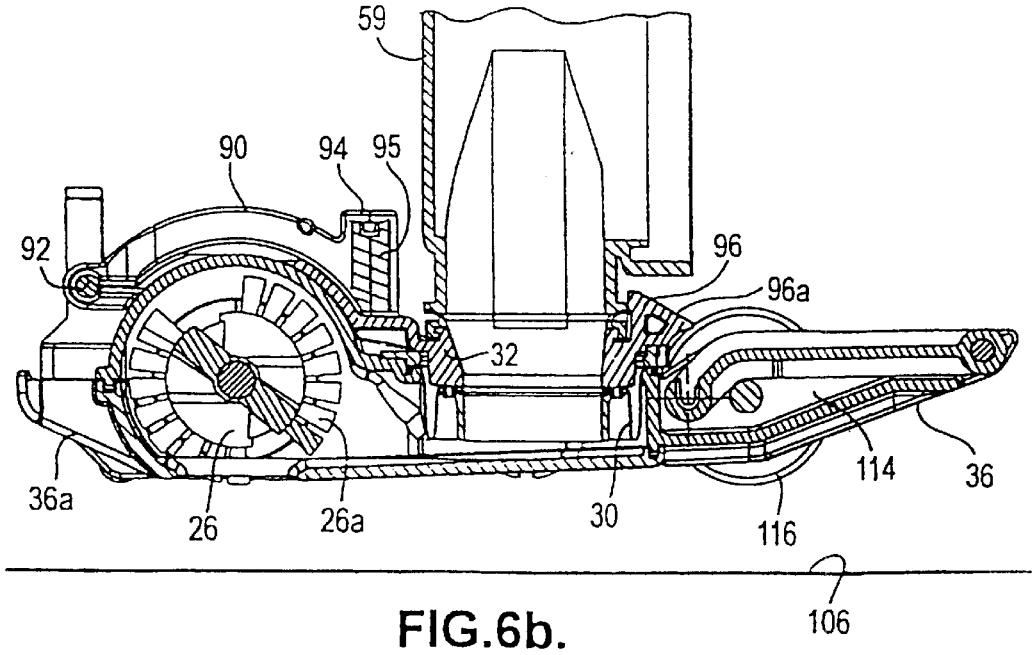
FIG. 6*b* is a sectional view through the cleaner head of FIG. 5 showing the cleaner head in the second position as shown in FIG. 4*b*.

The entire cyclonic separator 52 is releasable from the chassis 12. A seal arm 90 (see FIG. 6) is pivotally mounted about a pivot point 92 on the chassis 12. The seal arm 90 carries an inlet port 32 which communicates with the cleaner head 22 by means of a rolling seal 30. The seal arm 90 is biased into an upward position (i.e. in a counterclockwise direction as seen in FIGS. 6*a* and 6*b*) by means of a compression spring 95 acting between a seat 94 of the seal arm 90 and a fixed part of the chassis 12 (not shown). The inlet port 32 carries a lip seal 33 located about the downstream mouth of the inlet port 32. When the cyclonic separator 52 is located on the chassis 12, the inlet port 32 is pressed against the mouth of the tangential inlet 59 of the end portion 58 to form a seal therewith so that air can flow from the cleaner head 22 directly into the outer cyclone 54. A hooked catch 96 is provided on the seal arm 90 adjacent the inlet port 32 and on the side thereof remote from the motor and fan unit 50. The cyclonic separator 52 is held in position by means of the hooked catch 96 (in conjunction with the location of the vortex finder in the aperture in the end wall of the end portion) when the cleaner 10 is in use. A button 34 located in the control panel 44 is connected by a rod (not shown) to a projection 97 on the seal arm 90 so that pressing the button 34 causes the seal arm 90 to move in a clockwise direction (as seen in FIG. 6) against the bias of the spring 95. The inlet port 32 moves away from the mouth of the tangential inlet 59 so as to break the seal therewith. The hooked catch 96 is then released from the mouth of the tangential inlet 59 so that the cyclonic separator 52 can be lifted away from the chassis 12 by means of the gripper portions 70. The bin 62 can subsequently be released from the end portion 58 (which carries with it the shroud 80 and the inner cyclone body 72) to facilitate the emptying thereof. When the cyclonic separator 52 is to be reconnected to the chassis 12, the cyclonic separator 52 is moved into the connected position. This movement brings the forward edge of the tangential inlet 59 into abutment with the hooked catch 96 which has an inclined side surface 96*a*. This arrangement causes the hooked catch 96 to be forced downwardly as the tangential inlet 59 moves into the correct position. When the tangential inlet 59 is in the correct position, the hooked catch 96 is urged upwardly into the operative position shown in FIG. 6 so that the cyclonic separator 52 is again held in position on the chassis 12. During the relative movement between the two parts, i.e., the chassis 12 and the cyclonic separator 52, the seal 33 is out of contact with the tangential inlet 59 so that no unnecessary wear is applied to the seal 33.

Figure 5:
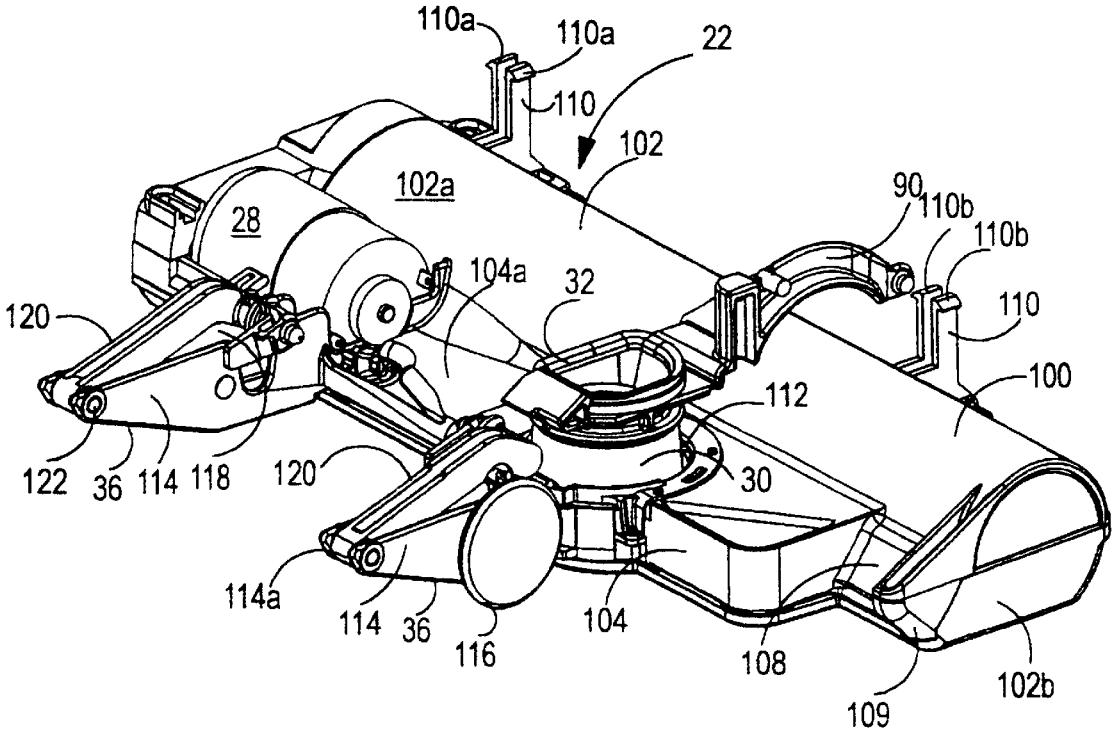
FIG. 5 is a perspective view of the cleaner head of the vacuum cleaner shown in FIG. 1.

The features of the cleaner head 22 will now be described in greater detail. The cleaner head assembly is shown in detail in FIG. 5 and features can also be seen in FIGS. 4 and 6. The cleaner head 22 comprises a housing 100 which has a rear part 102 and a front part 104. The rear part 102 has a generally egg-shaped cross-section having an arcuate upper surface 102*a* and end walls 102*b*. The lower face 102*c* of the rear part 102 is generally planar but also defines the suction opening 24 which opens downwardly so as to face the floor or surface to be cleaned 106. Supporting rollers 107 (see FIG. 2) are located in the lower face 102*c* of the housing 100 forwardly of the suction opening 24 for supporting the cleaner head 22. The brush bar 26 is mounted in the rear part 102 (see FIG. 6) by way of bearings (not shown) in the normal way. As is known, the brush bar 26 is mounted in the rear part 102 so that the bristles 26*a* of the brush bar 26 protrude beyond the plane of the suction opening 24 in order to provide good pick up.

Extending upwardly from the rear edge of the rear part 102 are two projections 110 which are spaced away from one another along the said rear edge. The projections 110 each consist of upwardly extending legs 110*a* having a gap therebetween and an overhanging lip 110*b* at the upper end thereof The purpose of the projections is to hold the cleaner head 22 captive on the chassis 12 whilst allowing the cleaner head 22 to move freely in a vertical direction within the limits set out by the projections 110. This is achieved by the fact that the projections 110 are received in recesses in the chassis 12, the recesses having downwardly facing openings through which the legs 110*b* may pass. The openings are dimensioned so that the overhanging lips 110*b* will abut against the edges thereof. The legs 110*a* are made from a slightly resilient plastics material so that they can be pressed together to allow the lips 110*b* to pass through the openings in the chassis 12 but are prevented from returning through the openings. In this way, the cleaner head 22 is held captive on the chassis 12 but is free to move in a vertical direction between the position in which the cleaner head 22 touches the chassis 12 and the position in which the lips 110*b* abut against the openings in the chassis 12. Additional ramp portions 36*a* extend outwardly from the rear edge of the rear part 102 of the housing 100 and the purpose of these additional ramp portions will be described below.

The front part 104 of the housing 100 projects forwardly from the rear part 102 and has a generally rectangular cross-section. The lower surface 104*c* of the front part is contiguous with the lower face 102*c* of the rear part 102. The front part 104 opens into the rear part 102 so that, in use, air entering through the suction opening 24 travels from the rear part 102 into the front part 104. The front part 104 is narrower that the rear part 102 so that a shoulder 108 is formed on the rear part 102 on one side thereof. A forwardly inclined ramp portion 109 is located on the shoulder 108 for a purpose which will be described below. The motor 28 is supported on the upper surface 104*a* of the front part 104 and the motor 28 is connected in a suitable way to the brush bar 26 so that the brush bar 26 can be driven by the motor 28. The connection can take the form of a drive belt (not shown) extending between a shaft of the motor 28 and a pulley area of the brush bar. The drive belt is then shielded by the upper surface 104*a* of the front part 104 to protect the belt and to eliminate any risk of injury to a user.

An aperture 112 is located in the upper surface 104*a* of the front part 104. The aperture 112 forms the only air exit from the housing 100 of the cleaner head 22, the suction opening 24 forming the only air inlet. The housing 100 is otherwise completely sealed. The rolling seal 30, which is formed from rubber or a synthetic rubber, is secured around the periphery of the aperture 112. The other end of the rolling seal 30 is secured to the inlet port 32 of the seal arm 90 as described above. The rolling seal 90 thus provides an airtight passageway from the cleaner head 22 to the inlet port 32 which, in turn, communicates with the cyclonic separator 52. The flexibility of the rolling seal 90 accommodates any vertical movement of the cleaner head 22 with respect to the chassis 12. As the cleaner head 22 moves upwardly with respect to the chassis 12, the rolling seal 90 merely folds or crumples to accommodate the change in relative positions. This is illustrated in FIGS. 6*a* and 6*b*.

Extending forwardly from the front of the front part 104 are two connection members 114. The connection members 114 are spaced apart from one another along the front edge of the front part 104 and project forwardly in a direction which is parallel to the longitudinal axis of the cleaner chassis 12, ie in the direction of forward travel of the cleaner 10. Specifically, the connection members 114 are symmetrically located about the central line of the chassis 12. The connection members 114 are rigidly attached to the front part 104 or can be moulded integrally therewith. Each connection member 114 carries a wheel 116 which is freely pivotable within an aperture located in the connection member 114. Each wheel 116 supports the cleaner head 22 on the surface to be cleaned 106 (see FIG. 6*a*).

The cross-section of each connection member 114 is generally U-shaped with a recess 118 being formed in the upper side thereof. An articulating member 120 is pivotably connected to the front end 114*a* of each connection member 114 via a pivot joint 122. The articulating members 120 are generally elongate with square or rectangular cross-sections which are sufficiently small that the articulating members 120 can be received within the recesses 118 of the connection members 114 when the articulating members 120 are pivoted into a position in which the two respective members lie close to one another. It will be appreciated that the identical effect could be achieved by providing a recess in the articulating members so that the respective connection members could be received therein. The connection members 114 have upwardly inclined lower surfaces in the form of ramps 36 whose purpose will be described below.

At the end of each articulating member 120 remote from the pivot joint 122, each articulating member 120 has a connection 124 which is adapted to be connected to a connection point located on the underside of the chassis 12. The connection point on the chassis 12 is located so that, when the articulating members 120 are connected to the chassis 12, the connections 124 are located substantially above the proximal ends of the connection members 114, ie above the ends thereof which are closest to the housing 100. In this way, the articulating members 120 are located generally above the connection members and also extend in the same direction as the connection members. The cleaner head is effectively pushed rather than pulled across the surface to be cleaned. The chassis 12 and the relevant connection point have been omitted for the sake of clarity from FIGS. 5 and 6. Suffice it to say that the connection 124 of each articulating member 120 is connected to a fixed point on the chassis 12 but that the connection 124 is such that the articulating member 120 is free to pivot about the said fixed point. This pivoting connection of the articulating member 120 to the chassis 12, combined with the pivoting connection between the articulating member 120 and the connection member 114, provides a doubly articulated connection between the cleaner head 22 and the chassis 12. The result is that any upward movement of the cleaner head 22 is in a substantially vertical direction instead of being an arcuate movement. This allows the connection between the cleaner head 22 and the inlet 32 to the cyclonic separator 52 to be simpler to construct and more reliable.

The vacuum cleaner 10 described above operates in the following manner in a robotic mode. In order for the cleaner 10 to traverse the area to be cleaned, the wheels 14 are driven by the motors 15 which, in turn, are powered by the batteries 46. The direction of movement of the cleaner 10 is determined by the control software which communicates with the sensors 40 which are designed to detect any obstacles in the path of the cleaner 10 so as to navigate the cleaner 10 around the area to be cleaned. Methodologies and control systems for navigating a robotic vacuum cleaner around a room or other area are well documented elsewhere and do not form part of the inventive concept of this invention. Any of the known methodologies or systems could be implemented here to provide a suitable navigation system.

The batteries 46 also provide power to operate the motor and fan unit 50 to draw air into the cleaner 10 via the suction opening 24 in the cleaner head 22. The end portion 58 communicates with the cleaner head 22. The motor 28 is also driven by the batteries 46 so that the brush bar 26 is rotated in order to achieve good pick-up, particularly when the cleaner 10 is to be used to clean a carpet. The dirty air is drawn into the cleaner head 22 and conducted to the cyclonic separator 52 via the telescopic conduit 30 and the inlet port 32. The dirty air then enters the end portion 58 in a tangential manner and adopts a helical path by virtue of the shape of the end wall 60. The air then spirals down the interior of the outer wall 64 of the bin 62 during which motion any relatively large dirt and fluff particles are separated from the airflow. The separated dirt and fluff particles collect in the end of the bin 62 remote from the entry portion 58. The fin 78 discourages uneven accumulation of dirt and fluff particles and helps to distribute the dirt and fluff collected around the end of the bin 62 in a relatively even manner.

The airflow from which dirt and larger fluff particles has been separated moves inwardly away from the outer wall 64 of the bin 62 and travels back along the exterior wall of the fine dust collector 74 towards the shroud 80. The presence of the shroud 80 also helps to prevent larger particles and fluff traveling from the outer cyclone 54 into the inner cyclone 56, as is known. The air from which comparatively large particles and dirt has been separated then passes through the shroud 80 and travels along the channel 84 between the shroud 80 and the outer surface of the inner cyclone body 72 until it reaches the inlet port 86 to the inner cyclone 56. The air then enters the inner cyclone 56 in a helical manner and follows a spiral path around the inner surface of the cyclone body 72. Because of the frustoconical shape of the cyclone body 72, the speed of the airflow increases to very high values at which the fine dirt and dust still entrained within the airflow is separated therefrom. The fine dirt and dust separated in the inner cyclone 56 is collected in the fine dust collector 74 outwardly of the dust ring 68. The dust ring 68 discourages re-entrainment of the separated dirt and dust back into the airflow. When the fine dirt and dust has been separated from the airflow, the cleaned air exits the cyclonic separator via the vortex finder (not shown). The air is passed over or around the motor and fan unit 50 in order to cool the motor before it is expelled into the atmosphere. The cyclonic separator 52 is released from the chassis 12 in the manner described above when the bin 62 has to be emptied.

It has been mentioned at the outset that arcuate lifting of the cleaner head does not allow the cleaner head to follow contours of the surface to be cleaned or to lift over small obstacles without the suction opening being moved away from the surface for longer than is desirable. The arrangement described above provides the cleaner head 22 with a high degree of flexibility of movement which allows the suction opening 24 to follow the contours of the surface very closely. Specifically, it will be appreciated that the cleaner head 22 is able to follow a rocking-type movement in which the rear and front edges of the cleaner head 22 are alternately raised, should the contours of the surface 106 demand such a movement. The fact that two separate and unlinked connection and articulating member pairs are provided, one on either side of the center line of the chassis 12, means that the cleaner head can also tilt so that one side thereof is higher than the other and operate well in such an orientation. The flexibility of the rolling seal 90 allows the movement of the cleaner head 22 relative to the chassis 12 to be accommodated.

The cleaner head 22 is also able to lift itself over small obstacles in its path. The ramps 36 ensure that any obstacle over which the cleaner 100 wishes to pass is contacted by an inclined surface so that the cleaner head 22 is lifted as the cleaner 10 moves forward. If, by any chance, the obstacle approaches the cleaner head on one side of the ramps 36, then the ramp portion 109 will also lift the cleaner head 22 over the obstacle if it comes into contact with the obstacle. The additional ramp portions 36*a* located on the rear edge of the rear portion 104 will lift the cleaner head 22 over an obstacle if the cleaner 10 is moving in reverse when the obstacle is approached. The fact that the ramp portions 36, 36*a* and the ramp surfaces 109 are not directly concerned with the connection of the cleaner head 22 to the chassis 12 means that these surfaces can be relatively short and steeply inclined. This means that any lifting of the cleaner head 22 away from the surface 106 to be cleaned occurs at the last possible opportunity and the cleaner head 22 is thus left in contact with the surface 106 for longer than would otherwise be the case. This contributes greatly to the efficiency and efficacy of the cleaning operation carried out by the cleaner 10.

The invention is not intended to be restricted in scope to the precise details of the embodiment described above. Particularly, it is to be appreciated that the cleaner head of any other type of vacuum cleaner can be attached to the chassis or main body thereof in the manner described above. The vacuum cleaner need not be robotic but could, for example, be an upright cleaner. The arrangement could also be used in a floor tool for use with a cylinder or backpack cleaner. However, it is recognised that a particularly appropriate use of the invention resides in cleaners which move predominantly in one direction and are required to continue to operate under awkward conditions with little or no human supervision. The preferred application is therefore in robotic vacuum cleaners. The skilled reader will also appreciate that many of the details disclosed above are given as examples only and have equivalents which are fully intended to fall within the scope of the invention.

What is claimed is:

1. A vacuum cleaner comprising a main body and a cleaner head movably mounted thereon, the cleaner head having a housing with a downwardly directed suction opening, and at least one connection member that extends forwardly of the cleaner head in a direction of forward travel of the vacuum cleaner, the cleaner head being mounted on the main body by means of at least one articulating member, the articulating member having a first end which is pivotably connected to an end of the connection member that is remote from the cleaner head and a second end which is pivotably connected to the main body, the articulating member being located above the connection member so that the connection member and articulating member extend in the direction of forward travel of the vacuum cleaner.

2. A vacuum cleaner as claimed in claim 1, wherein the connection member is connected to the cleaner head forwardly of the suction opening.

3. A vacuum cleaner as claimed in claim 1 or 2, wherein the connection member has an upwardly inclined lower surface.

4. A vacuum cleaner as claimed in claim 2, wherein the connection and articulating members form a pair of members configured so that one of the members is received into a groove or channel in the other of the members.

5. A vacuum cleaner as claimed in claim 4, wherein the or each connection member comprises a channel in which the respective articulating member is receivable.

6. A vacuum cleaner as claimed in claim 1, wherein the second end of the articulating member is located above an end of the connection member proximal to the main body.

7. A vacuum cleaner as claimed in claim 1, wherein the articulating member is pivotably connected to the main body at a point which is rearward of the point at which the articulating member is connected to the cleaner head.

8. A vacuum cleaner as claimed in claim 1, wherein the at least one articlating member comprises two articulating members spaced along the cleaner head.

9. A vacuum cleaner as claimed in claim 8, wherein the two articulating members are arranged so as to be parallel to one another.

10. A vacuum cleaner as claimed in claim 1, further comprising support wheels or rollers provided on the cleaner head both forwardly and rearwardly of the suction opening.

11. A vacuum cleaner as claimed in claim 1, wherein a brush bar is rotatably mounted in the cleaner head.

12. A vacuum cleaner as claimed in claim 11, wherein the cleaner head carries a motor for driving the brush bar.

13. A vacuum cleaner as claimed in claim 1, further comprising a flexible conduit provided between the cleaner head and the main body of the vacuum cleaner.

14. A vacuum cleaner as claimed in claim 13, wherein the flexible conduit comprises a sleeve sealingly connected about an aperture in the cleaner head.

15. A vacuum cleaner as claimed in claim 1, wherein the main body comprises a cyclonic separating apparatus for separating dirt and dust from an airflow.

16. A vacuum cleaner as claimed in claim 15, wherein the cyclonic separating apparatus comprises two cyclones arranged in series.

17. A vacuum cleaner as claimed in claim 1, wherein the main body comprises navigation and control apparatus for navigating the vacuum cleaner over a surface to be cleaned.

* * * * *